US010971105B2

(12) United States Patent
Chen

(10) Patent No.: US 10,971,105 B2
(45) Date of Patent: Apr. 6, 2021

(54) PIXEL DRIVING CIRCUIT, DRIVING METHOD AND DISPLAY DEVICE

(71) Applicants: HKC Corporation Limited, Guangdong (CN); Chongqing HKC Optoelectronics Technology Co., Ltd., Chongqing (CN)

(72) Inventor: Yu-Jen Chen, Chongqing (CN)

(73) Assignees: HKC Corporation Limited, Shenzhen (CN); Chongqing HKC Optoelectronics Technology Co., Ltd., Chongqing (CN)

( * ) Notice: Subject to any disclaimer, the term of this patent is extended or adjusted under 35 U.S.C. 154(b) by 0 days.

(21) Appl. No.: 16/612,098

(22) PCT Filed: Jul. 4, 2017

(86) PCT No.: PCT/CN2017/091678
§ 371 (c)(1),
(2) Date: Nov. 8, 2019

(87) PCT Pub. No.: WO2018/205398
PCT Pub. Date: Nov. 15, 2018

(65) Prior Publication Data

US 2020/0118511 A1 Apr. 16, 2020

(30) Foreign Application Priority Data

May 11, 2017 (CN) ..... 201710330458.7

(51) Int. Cl.
*G09G 3/36* (2006.01)

(52) U.S. Cl.
CPC ..... *G09G 3/3688* (2013.01); *G09G 3/3614* (2013.01); *G09G 3/3648* (2013.01);
(Continued)

(58) Field of Classification Search
CPC ..... G09G 3/20; G09G 3/3607; G09G 3/3614; G09G 3/3648; G09G 3/3677;
(Continued)

(56) References Cited

U.S. PATENT DOCUMENTS 7,538,843 B2 * 5/2009 Kim ..... G02F 1/1345 349/139
8,525,769 B2 * 9/2013 Miyashita ..... G09G 3/3614 345/96
2011/0285950 A1 11/2011 Su et al.

FOREIGN PATENT DOCUMENTS

CN 101566744 A 10/2009
CN 101996603 A 3/2011
(Continued)

*Primary Examiner* — Nelson M Rosario
(74) *Attorney, Agent, or Firm* — Muncy, Geissler, Olds & Lowe, P.C.

(57) ABSTRACT

A pixel driving circuit comprises a pixel array, data lines and scan lines. The pixel array includes a plurality of pixel units having four sub-pixels with different colors. All of the sub-pixels are arranged in a dot inversion arrangement, and positive and negative polarities of the sub-pixels are alternately arranged. The data lines and the scan lines are orthogonally disposed to define a pixel array. Two of the scan lines are provided for each column of pixel units, and two of the data lines are provided for each row of pixel units. Each data line is connected to two closest sub-pixels with the same polarity when passing through one column of pixel units, and all the sub-pixels connected to the same data line in the row direction have the same polarity. The sub-pixels connected to the adjacent data lines have reverse polarities.

9 Claims, 11 Drawing Sheets

(52) U.S. Cl.
CPC ... *G09G 3/3677* (2013.01); *G09G 2300/0426* (2013.01); *G09G 2300/0452* (2013.01); *G09G 2310/0202* (2013.01)

(58) Field of Classification Search
CPC ..... G09G 3/3688; G09G 2300/0426; G09G 2300/0452; G09G 2310/0202; G09G 2310/0254; G09G 2330/021; G09G 3/36; G02F 1/13
See application file for complete search history.

(56) References Cited

FOREIGN PATENT DOCUMENTS

| | | | |
|---|---|---|---|
| CN | 102750919 | A | 10/2012 |
| CN | 103065596 | A | 4/2013 |
| CN | 104658489 | A | 5/2015 |
| JP | 2014026069 | A | 2/2014 |

* cited by examiner

PIXEL DRIVING CIRCUIT, DRIVING METHOD AND DISPLAY DEVICE

CROSS REFERENCE TO RELATED APPLICATIONS

This Non-provisional application is a national phase of a PCT Application No. PCT/CN2017/091678 filed on Jul. 4, 2017, claiming priority on Patent Application No(s). 201710330458.7 filed in People's Republic of China on May 11, 2017, the entire contents of which are hereby incorporated by reference.

BACKGROUND

Technology Field

This disclosure relates to a pixel driving circuit, a driving method and a display device.

Description of Related Art

With the continuous increases of the resolution and the scan rate of the display, the pixel layout design based on the half source driving (HSD) architecture is adopted in many products upon the panel design in order to decrease the number of used source integrated circuits (IC).

However, for the conventional HSD pixel layout design, the polarity conversion of the source voltage signal thereof in one frame must be made, so that the power consumption of the source IC significantly increases. In addition, the temperature of the IC also rises upon frame displaying so that the reliability quality is deteriorated.

SUMMARY

In view of above, it is desired to provide a pixel driving circuit, a driving method and a display device capable of decreasing the power consumption.

A pixel driving circuit includes a pixel array, data lines and scan lines. The pixel array includes a plurality of pixel units. Each of the pixel units has four sub-pixels with different colors. All of the sub-pixels are arranged in a dot inversion arrangement, and the positive and negative polarities of the sub-pixels are alternately disposed. The data lines and the scan lines are orthogonally disposed to define a pixel array. Two of the scan lines are provided for each of columns of the pixel units, and two of the data lines are provided for each of rows of the pixel units. Each of the data lines is connected to closest two of the sub-pixels having the same polarity when passing through one of the columns of the pixel units. All the sub-pixels connected to the same data line in a row direction have the same polarity, and the sub-pixels connected to the adjacent data lines have reverse polarities.

A pixel driving method applicable to the above-mentioned pixel driving circuit includes the following steps of: obtaining data line driving voltage signals having positive and negative polarities with row inversion arrangements; controlling two scan line driving voltage signals of each of the columns of the pixel units to be inputted concurrently, and inputting the two scan line driving voltage signals of each of columns in order; when the two scan line driving voltage signals of one column of the pixel units are inputted concurrently, each of rows of data lines writes voltage signals to two sub-pixels, wherein the two sub-pixels are disposed on two sides of the data line and are arranged alternately; and judging whether a writing time of the voltage signal is longer than one frame or not, performing polarity switching of the voltage signal in one cycle of each frame if the writing time is longer than one frame, and holding the polarity of the voltage signal unchanged in one frame if the writing time is not longer than one frame.

A display device includes a source driving chip, a gate driving chip, and a display panel. The source driving chip is configured to be connected to a plurality of data lines, which are connected to a display panel and configured in a row inversion arrangement, and positive and negative polarities of the sub-pixels are alternately disposed. The gate driving chip is configured to be connected to a plurality of scan lines, which are connected to the display panel and are paired to drive one column of pixel units. The display panel is divided into a plurality of pixel sets by the data lines and the scan lines. Each of the pixel sets has two sub-pixels having different colors and reverse polarities. The sub-pixels are arranged in parallel, and the sub-pixels of two adjacent pixel sets comprise white, red, green and blue colors.

In the pixel driving circuit and the display device, in which the technology of the HSD pixel layout design is utilized, the number of the source ICs used can be decreased, and the cost can be saved. The frame displaying quality is enhanced since the pixel polarity arrangement of the dot inversion is adopted. More importantly, since the technology of the HSD pixel layout design and the pixel polarity arrangement of the dot inversion are utilized, no polarity switching of the source voltage signal in one frame is needed, so that the power consumption of the overall display device and the temperature of the source IC are decreased, and the reliability quality is enhanced.

BRIEF DESCRIPTION OF THE DRAWINGS

The disclosure will become more fully understood from the detailed description and accompanying drawings, which are given for illustration only, and thus are not limitative of the present disclosure, and wherein.

DETAILED DESCRIPTION OF THE DISCLOSURE

Figure 1:
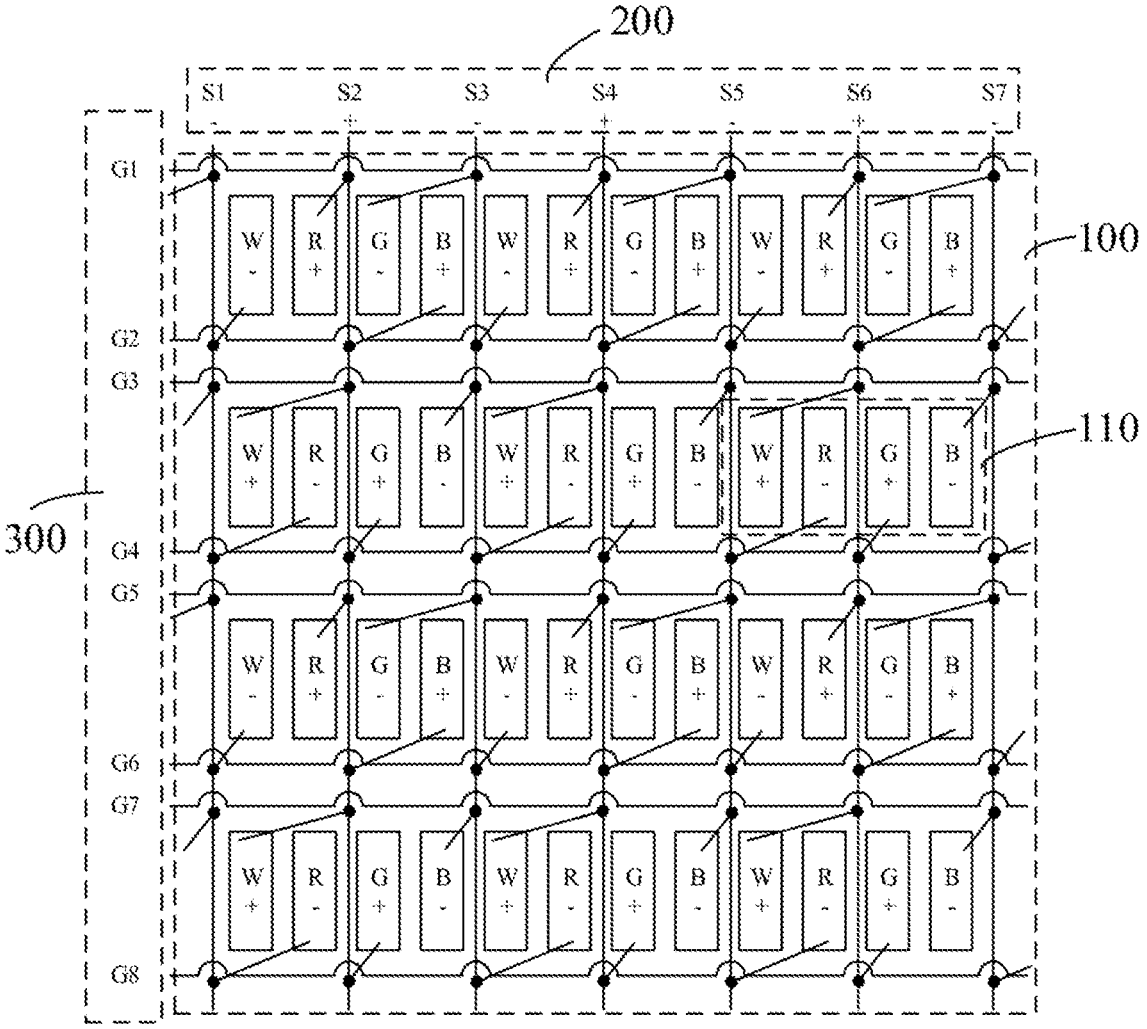
FIG. 1 is a schematic structure view showing a pixel driving circuit of one embodiment.

In order to make this disclosure be understood, more comprehensive descriptions of this disclosure will be made in the following with reference to the associated drawings. Preferred embodiments of this disclosure are given in the drawings. However, this disclosure may be implemented in various forms, and is not restricted to the embodiments disclosed herein. On the contrary, the purpose of providing these embodiments is to make the contents of this disclosure be understood more comprehensively.

FIG. 1 is a schematic structure view showing a pixel driving circuit of one embodiment. Referring to FIG. 1, the structure comprises a pixel array 100, data lines S1, S2, S3, . . . , S7, extending from a source driving chip 200 and scan lines G1, G2, . . . , G8, . . . extending from a gate driving chip 300. The pixel array 100 comprises a plurality of pixel units 110 having four sub-pixels with different colors, wherein dot inversion arrangements, in which positive and negative polarities of all the sub-pixels 110 are staggered or alternate, are present. That is, each sub-pixel and its adjacent sub-pixel have reverse polarities.

The data lines and the scan lines are orthogonally disposed in the pixel array, and, two scan lines are provided for each column of pixel units 110. For example, the scan lines G1, G2 are provided for the first column of pixel units. Two data lines are provided for each row of pixel units 110. For example, the data lines S1, S2 are provided for the first row of pixel units. Each data line passes through a plurality of columns of pixel units.

When each data line passes through one column of pixel units, it is connected to two nearest sub-pixels with the same polarity (may be two sub-pixels in the same pixel unit or two sub-pixels in different pixel units), and all the sub-pixels connected to the same data line in the row direction have the same polarity. For example, the sub-pixel with the negative polarity is connected to the data line S1, and the sub-pixel with the positive polarity is connected to the data line S2. The sub-pixels connected to the adjacent data lines have reverse polarities. The sub-pixels connected to the data lines S1, S2, S3, S4 . . . have the negative polarity, the positive polarity, the negative polarity, the positive polarity . . . in order.

In the above-mentioned embodiment, only two data lines are provided for each row of pixel units so that the number of the source ICs used can be decreased, and the cost can be saved. All the sub-pixels connected to the same data line have the same polarity, so that no polarity switching of the source voltage signal in one frame is needed, and that the power loss and the temperature of the source IC can be decreased. The dot inversion arrangements, in which positive and negative polarities of the sub-pixels are staggered or alternate, are present to enhance the frame displaying quality.

Figure 2:
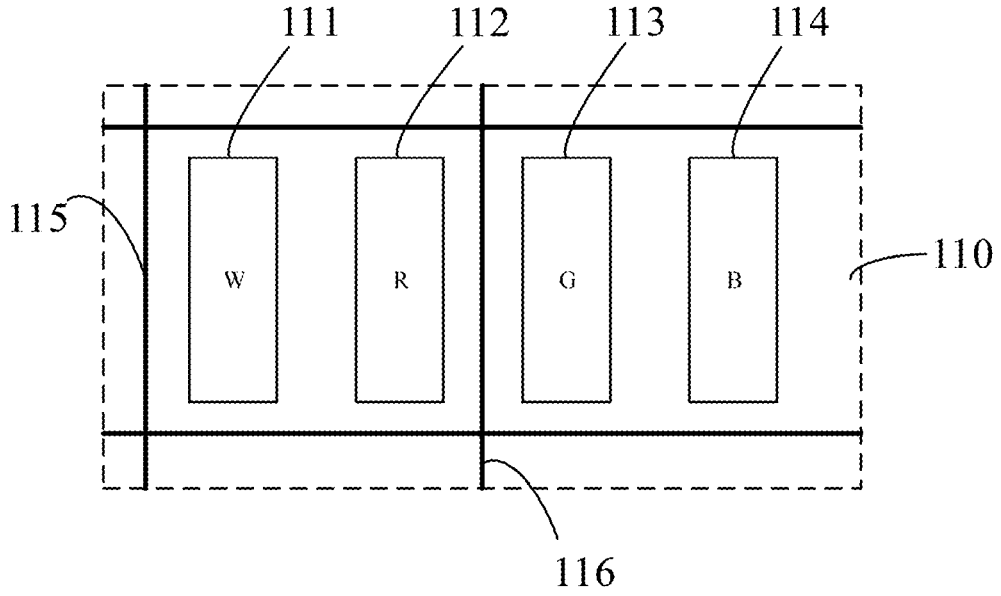
FIG. 2 is a schematic structure view showing a pixel unit of one embodiment.

More specifically, referring to FIG. 2, the pixel unit 110 comprises a first sub-pixel 111, a second sub-pixel 112, a third sub-pixel 113 and a fourth sub-pixel 114. The first sub-pixel 111 is a white sub-pixel, the second sub-pixel 112 is a red sub-pixel, the third sub-pixel 113 is a green sub-pixel, the fourth sub-pixel 114 is a blue sub-pixel, and each sub-pixel has positive and negative polarities.

For one of the pixel units 110, the arranged two data lines therefor are a first data line 115 and a second data line 116, respectively. Referring to FIG. 2, the first data line 115 may be located on the left side of the overall pixel unit 110, and two sub-pixels are interposed between the second data line 116 and the first data line 115. It is understood that two data lines may also be integrally shifted rightwards by one sub-pixel or two sub-pixels.

When each data line passes through one row of pixel units 110, two electrical connection wires are branched and respectively connected to two sub-pixels on two sides of the data line. One sub-pixel is interposed between the two sub-pixels. That is, the data line is connected to two separated sub-pixels respectively disposed on two sides of the data line. In addition, the polarity of the data line in one frame is held unchanged. Thus, all the sub-pixels connected to the same data line have the same polarity.

In order to facilitate the description, the multiple columns of pixel units are defined as odd-numbered columns of pixel units and even-numbered columns of pixel units.

The pixel units may be arranged into the pixel array in two arrangement forms. In the first form, the sub-pixels of the odd-numbered columns and even-numbered columns of pixel units are correspondingly aligned. That is, the sub-pixels with the same color are disposed on the same row (FIG. 1 pertains to this arrangement). The second form is based on the first form, and the sub-pixels of the odd-numbered columns and even-numbered columns of pixel units are offset by two sub-pixels. In order to facilitate the description, the arrangement of the sub-pixels of the odd-numbered columns of pixel units is defined as a first order, and the arrangement of the sub-pixels of the even-numbered columns of pixel units is defined as a second order for the second arrangement of the pixel array. In this embodiment, the first order represents that the first sub-pixel 111, the second sub-pixel 112, the third sub-pixel 113 and the fourth sub-pixel 114 are arranged in order, and the second order represents that the third sub-pixel 113, the fourth sub-pixel 114, the first sub-pixel 111 and the second sub-pixel 112 are arranged in order.

Due to the dot inversion arrangements where the positive and negative polarities of each sub-pixel are staggered or alternate and each sub-pixel arrangement order is the first order or the second order, the sub-pixels with the same color have the reverse polarities in the odd-numbered columns and even-numbered columns of pixel units. For example, if the first sub-pixel 111 in the odd-numbered column is white and has the negative polarity, then the first sub-pixel 111 in the even-numbered column is white and has the positive polarity.

Various specific pixel arrangement and sub-pixel connection conditions will be described in the following.

Figure 3:
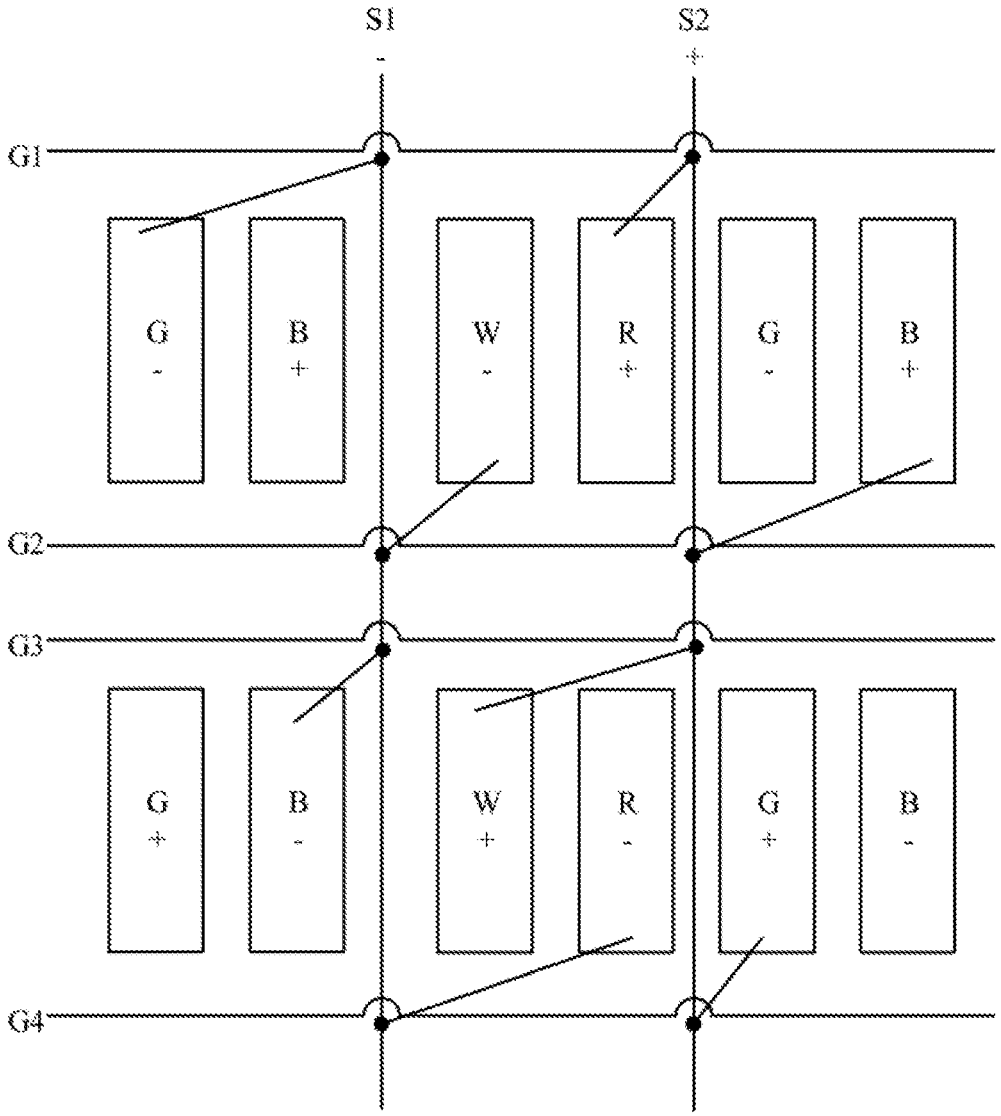
FIG. 3 is a schematic wiring view showing a sub-pixel of the pixel unit of one embodiment.

In one of the embodiments, as shown in FIG. 3, four sub-pixels in the odd-numbered columns and even-numbered columns of pixel units have the same arrangement order being the first order, the data lines in the pixel array are connected to the sub-pixel of the pixel unit as follows: in the odd-numbered columns, the first data line S1 is connected to the third sub-pixel (G) in its adjacent row of pixel units and the first sub-pixel (W) in the current row of pixel units, and the second data line S2 is connected to the second sub-pixel (R) in the current row of pixel units and the fourth sub-pixel (B) in the current row of pixel units; and in the even-numbered columns, the first data line S1 is connected to the fourth sub-pixel (B) in its adjacent row of pixel units and the second sub-pixel (R) in the current row of pixel units, and the second data line S2 is connected to the first sub-pixel (W) in the current row of pixel units and the third sub-pixel (G) in the current row of pixel units.

In this embodiment, the first data line S1 has the negative polarity, and the second data line S2 has the positive polarity. With the above-mentioned connection configuration, the first sub-pixel is white and has the negative polarity, the second sub-pixel is red and has the positive polarity, the third sub-pixel is green and has the negative polarity, and the fourth sub-pixel is blue and has the positive polarity in the odd-numbered columns of pixel units; and the first sub-pixel is white and has the positive polarity, the second sub-pixel is red and has the negative polarity, the third sub-pixel is green and has the positive polarity, and the fourth sub-pixel is blue and has the negative polarity in the even-numbered columns of pixel units. In addition, each sub-pixel of the odd-numbered column and each sub-pixel of the even-numbered column are aligned in order. Thus, all the sub-pixels satisfy the dot inversion arrangements where the positive and negative polarities alternate, and the first data line S1 and the second data line S2 in one frame do not need the polarity conversion.

Figure 4:
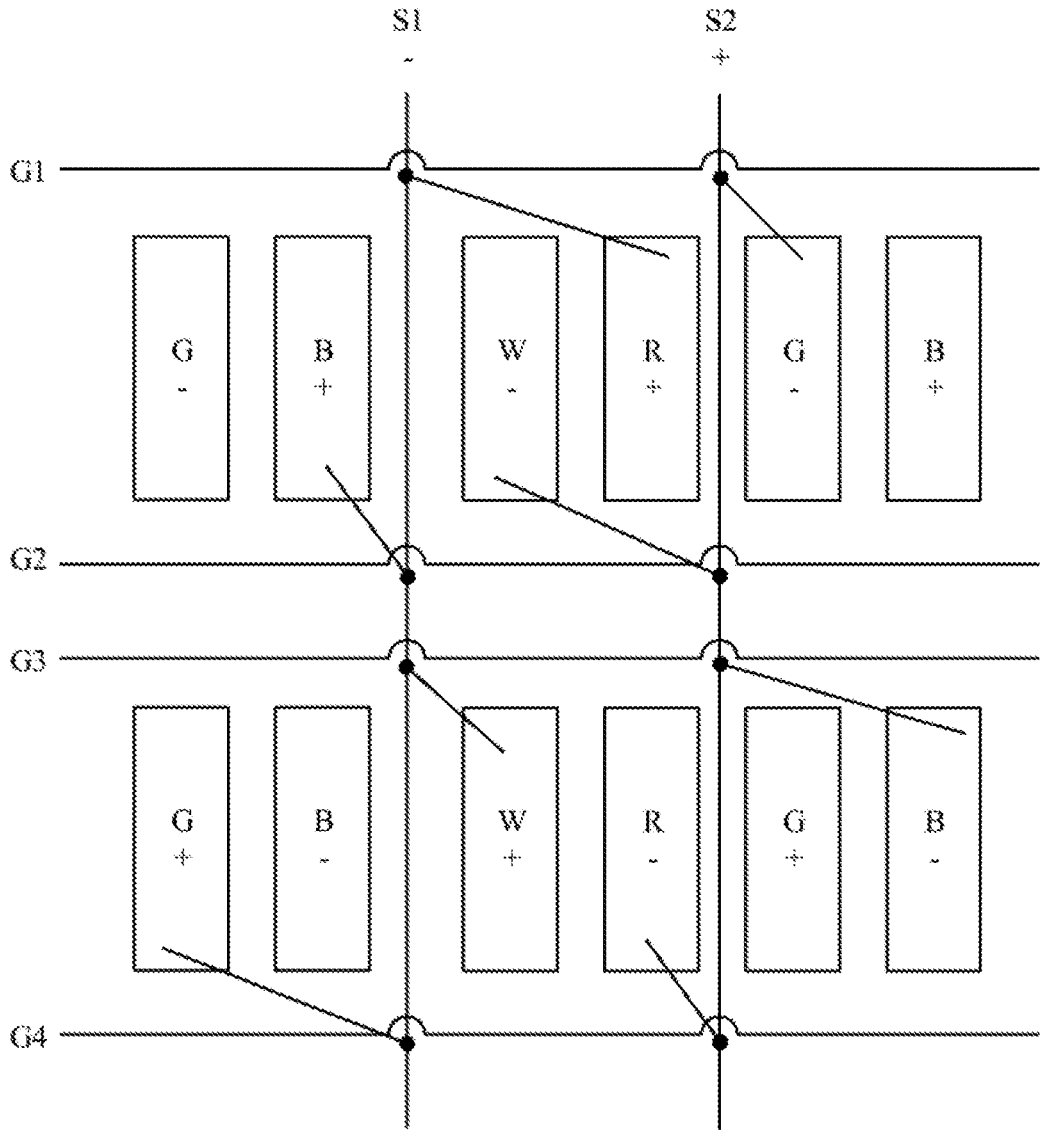
FIG. 4 is a schematic wiring view showing a sub-pixel of the pixel unit of another embodiment.

In another embodiment, as shown in FIG. 4, the four sub-pixels in the odd-numbered columns and even-numbered columns of pixel units have the same arrangement order being the first order, the data lines in the pixel array are connected to the sub-pixel of the pixel unit as follows: in the odd-numbered columns, the first data line S1 is connected to the fourth sub-pixel (B) in its adjacent row of pixel units and the second sub-pixel (R) in the current row of pixel units, and the second data line S2 is connected to the first sub-pixel (W) in the current row of pixel units and the third sub-pixel (G) in the current row of pixel units; and in the even-numbered columns, the first data line S1 is connected to the third sub-pixel (G) in its adjacent row of pixel units and the first sub-pixel (W) in the current row of pixel units, and the second data line S2 is connected to the second sub-pixel (R) in the current row of pixel units and the fourth sub-pixel (B) in the current row of pixel units.

Figure 5:
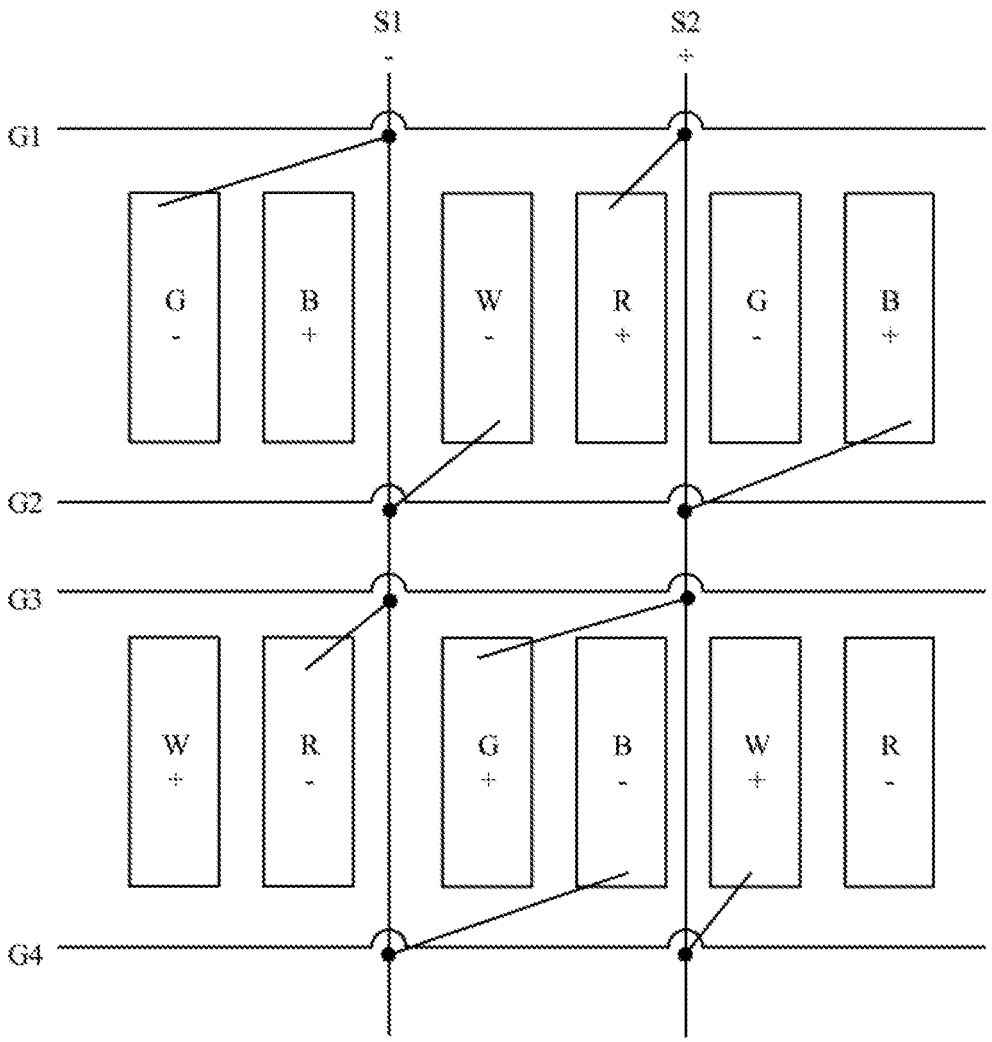
FIG. 5 is a schematic wiring view showing a sub-pixel of the pixel unit of another embodiment.

In one of the embodiments, as shown in FIG. 5, the four sub-pixels in the odd-numbered columns of pixel units are arranged in the first order, the four sub-pixels in the even-numbered columns of pixel units are arranged in the second order, and the data lines in the pixel array are connected to the sub-pixel of the pixel unit as follows: in the odd-numbered columns, the first data line S1 is connected to the third sub-pixel (G) in its adjacent row of pixel units and the first sub-pixel (W) in the current row of pixel units, and the second data line S2 is connected to the second sub-pixel (R) in the current row of pixel units and the fourth sub-pixel (B) in the current row of pixel units; and in the even-numbered columns, the first data line S1 is connected to the second sub-pixel (R) in its adjacent row of pixel units and the fourth sub-pixel (B) in the current row of pixel units, and the second data line S2 is connected to the third sub-pixel (G) in the current row of pixel units and the first sub-pixel (W) in the current row of pixel units.

In this embodiment, the first sub-pixel, the second sub-pixel, the third sub-pixel and the fourth sub-pixel of the odd-numbered columns are respectively aligned with the third sub-pixel, the fourth sub-pixel, the first sub-pixel and the second sub-pixel of the even-numbered columns in order.

Figure 6:
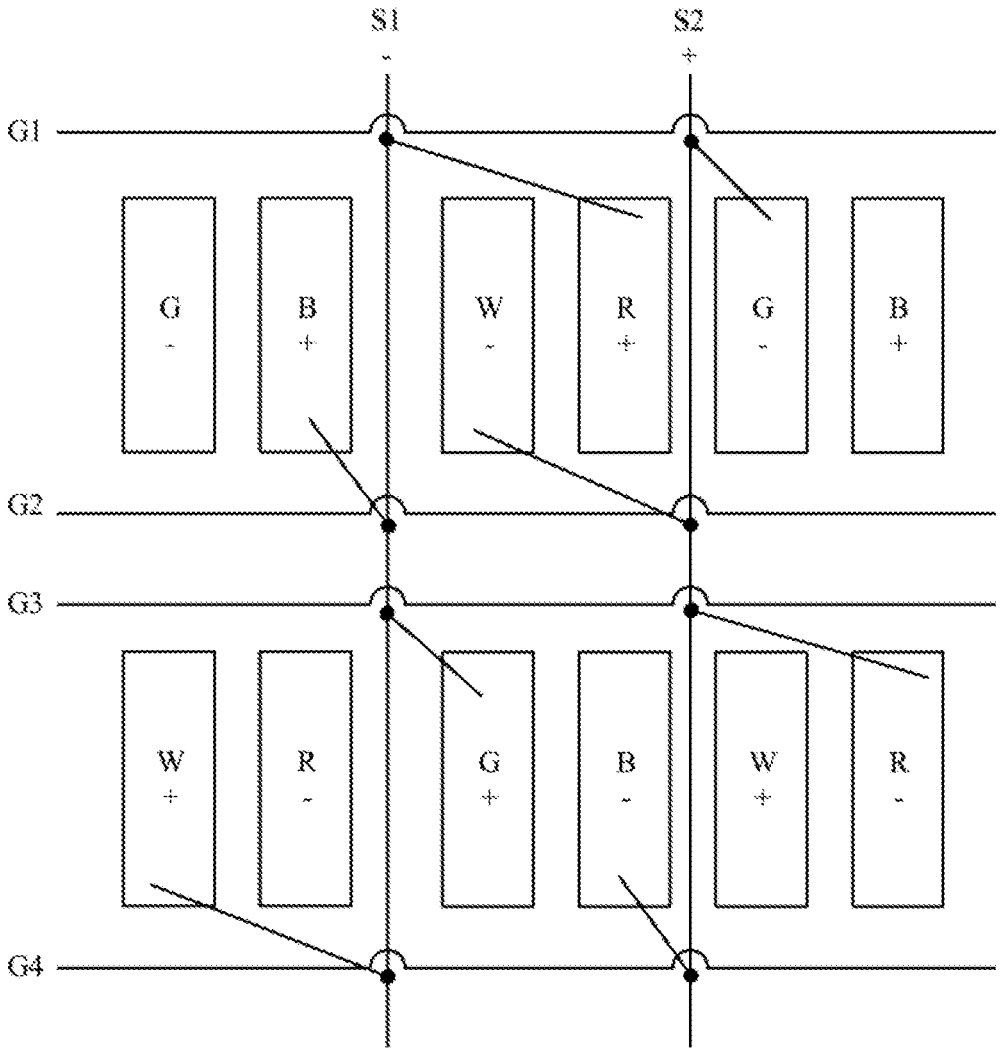
FIG. 6 is a schematic wiring view showing a sub-pixel of the pixel unit of another embodiment.

In another embodiment, as shown in FIG. 6, the four sub-pixels in the odd-numbered columns of pixel units are arranged in the first order, the four sub-pixels in the even-numbered columns of pixel units are arranged in the second order, and the data lines in the pixel array are connected to the sub-pixel of the pixel unit as follows: in the odd-numbered columns, the first data line S1 is connected to the fourth sub-pixel (B) in its adjacent row of pixel units and the second sub-pixel (R) in the current row of pixel units, and the second data line S2 is connected to the first sub-pixel (W) in the current row of pixel units and the third sub-pixel (G) in the current row of pixel units; and in the even-numbered columns, the first data line S1 is connected to the first sub-pixel (W) in its adjacent row of pixel units and the third sub-pixel (G) in the current row of pixel units, and the second data line S2 is connected to the fourth sub-pixel (B) in the current row of pixel units and the second sub-pixel (R) in the current row of pixel units.

Figure 7:
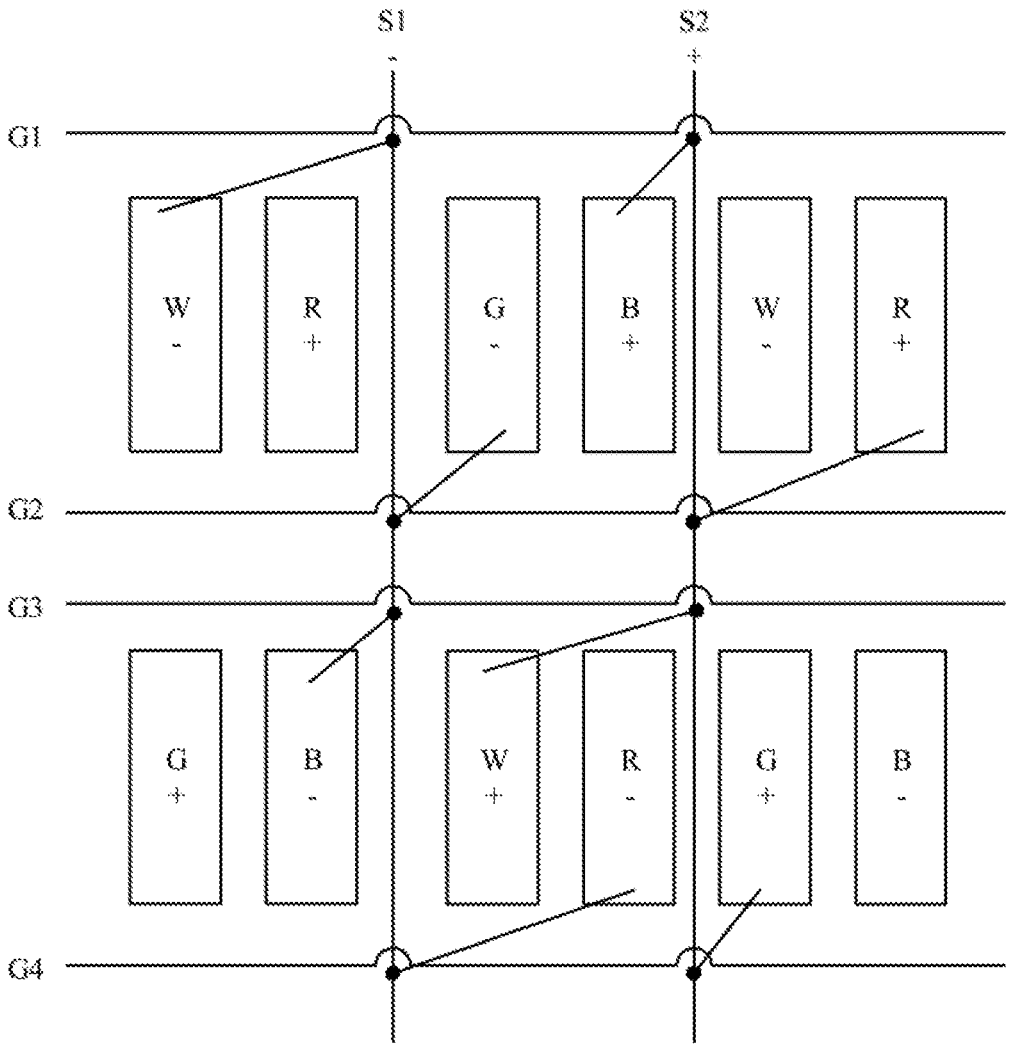
FIG. 7 is a schematic wiring view showing a sub-pixel of the pixel unit of another embodiment.

In one of the embodiments, as shown in FIG. 7, the four sub-pixels in the odd-numbered columns of pixel units are arranged in the second order, the tour sub-pixels in the even-numbered columns of pixel units are arranged in the first order, and the data lines in the pixel array are connected to the sub-pixel of the pixel unit as follows: in the odd-numbered columns, the first data line S1 is connected to the first sub-pixel (W) in its adjacent row of pixel units and the third sub-pixel (G) in the current row of pixel units, and the second data line S2 is connected to the fourth sub-pixel (B) in the current row of pixel units and the second sub-pixel (R) in the current row of pixel units; and in the even-numbered columns, the first data line S1 is connected to the fourth sub-pixel (B) in its adjacent row of pixel units and the second sub-pixel (R) in the current row of pixel units, and the second data line S2 is connected to the first sub-pixel (W) in the current row of pixel units and the third sub-pixel (G) in the current row of pixel units.

Figure 8:
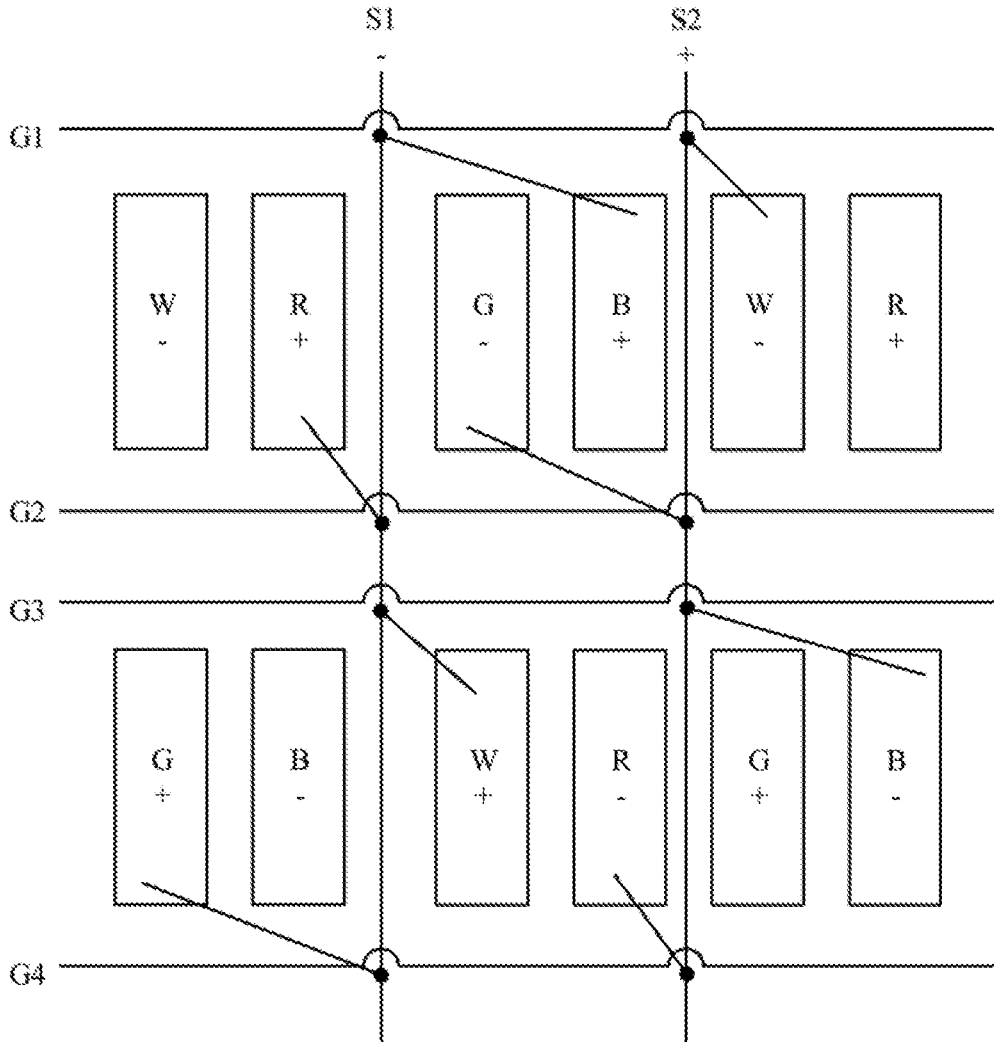
FIG. 8 is a schematic wiring view showing a sub-pixel of the pixel unit of another embodiment.

In another embodiment, as shown in FIG. 8, the four sub-pixels in the odd-numbered columns of pixel units are arranged in the second order, the four sub-pixels in the even-numbered columns of pixel units are arranged in the first order, and the data lines in the pixel array are connected to the sub-pixel of the pixel unit as follows: in the odd-numbered columns, the first data line S1 is connected to the second sub-pixel (R) in its adjacent row of pixel units and the fourth sub-pixel (B) in the current row of pixel units, and the second data line S2 is connected to the third sub-pixel (G) in the current row of pixel units and the first sub-pixel (W) in the current row of pixel units; and in the even-numbered columns, the first data line S1 is connected to the third sub-pixel (G) in its adjacent row of pixel units and the first sub-pixel (W) in the current row of pixel units, and the second data line S2 is connected to the second sub-pixel (R) in the current row of pixel units and the fourth sub-pixel (B) in the current row of pixel units.

Figure 9:
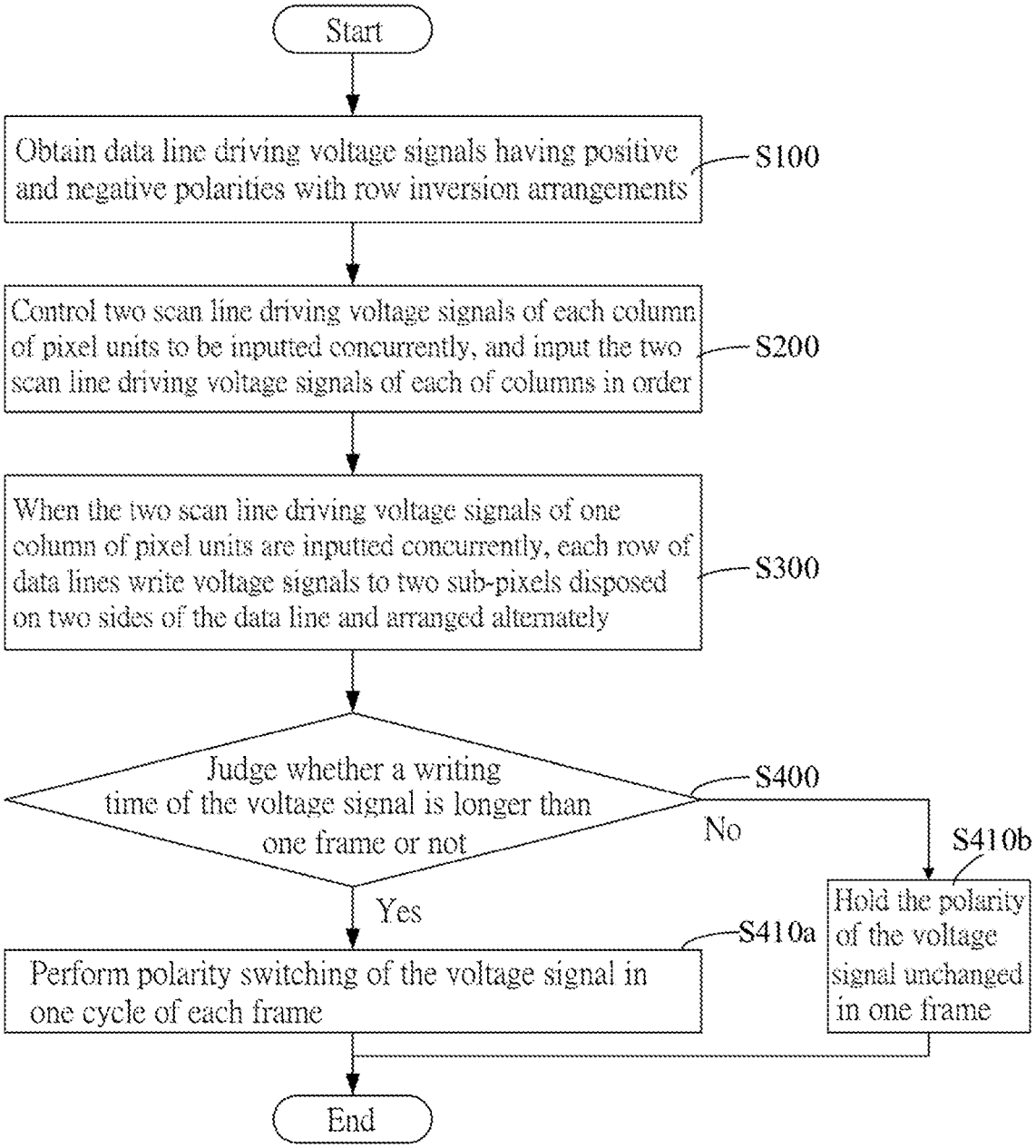
FIG. 9 is a flow chart showing a pixel driving method of one embodiment.

This disclosure further provides a pixel driving method applicable to the pixel driving circuit and the display device. As shown in FIG. 9, the method comprises the following steps.

In step S100, data line driving voltage signals having positive and negative polarities with row inversion arrangements are obtained.

In step S200, two scan line driving voltage signals of each column of pixel units are controlled to be inputted concurrently, and the two scan line driving voltage signals of each of columns are inputted in order.

In step S300, when the two scan line driving voltage signals of one column of pixel units are inputted concurrently, each row of data lines write voltage signals to two sub-pixels disposed on two sides of the data line and arranged alternately.

In step S400, it is judged whether a writing time of the voltage signal is longer than one frame. If yes, then step **S410*a* is executed. If not, then step S410*b*** is executed.

In the step **S410*a***, polarity switching of the voltage signal is performed in one cycle of each frame.

In the step **S410*b***, the polarity of the voltage signal is held unchanged in one frame.

In the pixel driving method, the voltage signal is the data line driving voltage signal provided by the source driving chip, and the voltage signals are configured in the row inversion arrangements where positive and negative polarities alternate. The scan line driving voltage signal is provided by a gate driving chip to control a thin film transistor (TFT) switch to implement writing of the data voltage signal.

Figure 10:
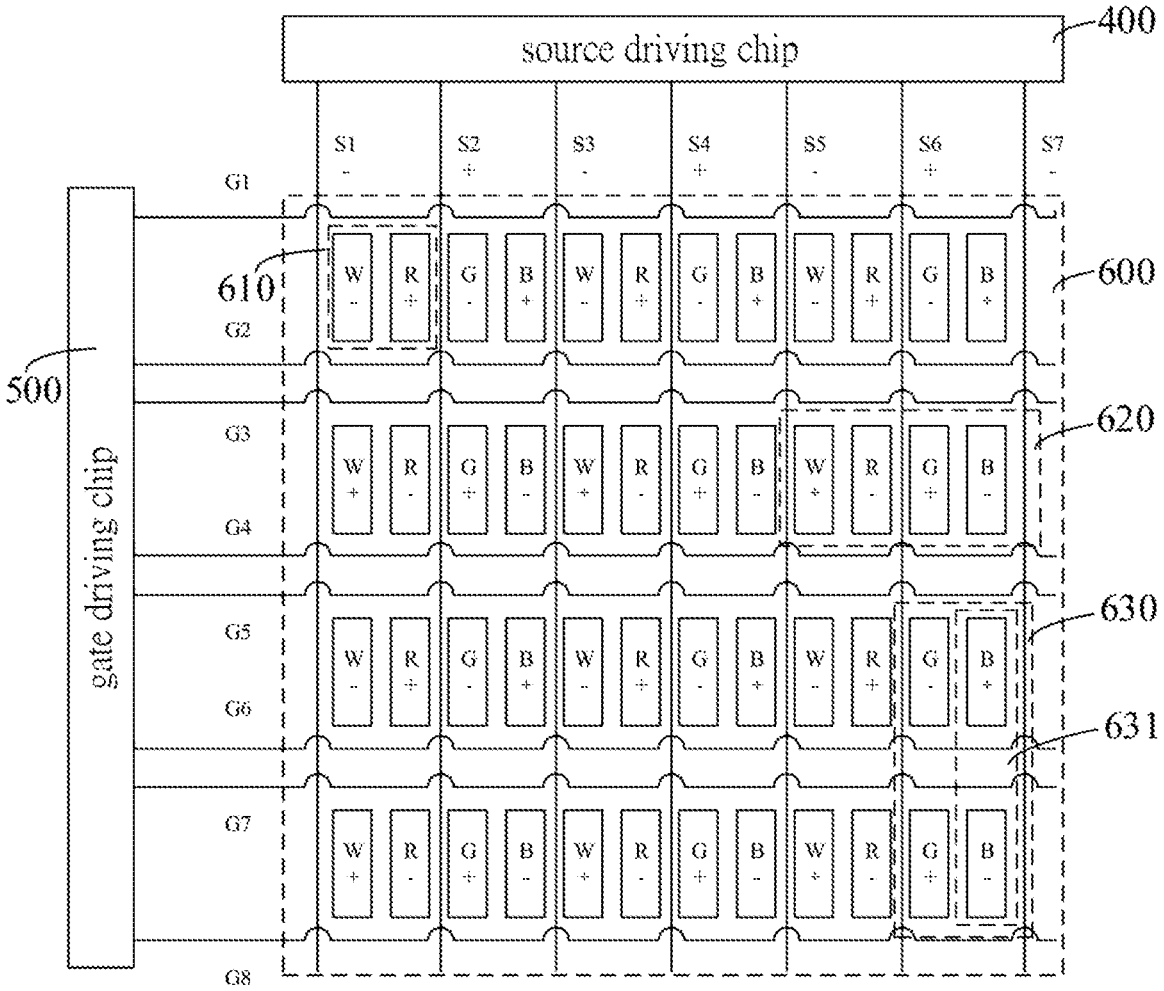
FIG. 10 is a schematic view showing a display panel structure of one embodiment.

This disclosure further provides a display device, as shown in FIG. 10. The display device comprises a source driving chip 400, a gate driving chip 500 and a display panel 600.

The source driving chip 400 is connected to a plurality of data lines S1, S2, S3, . . . , S7, . . . , and the data lines are connected to the display panel 600 and configured in the row inversion arrangements where positive and negative polarities alternate.

The gate driving chip 500 is connected to a plurality of scan lines G1, G2, . . . , G8, . . . . The scan lines are connected to the display panel 600, and are paired to drive one column of pixel units.

The display panel 600 is divided, by the data lines and the scan lines, into a plurality of pixel sets 610. Each pixel set has two sub-pixels having different colors and reverse polarities. The sub-pixels are arranged in parallel, and the sub-pixels of two adjacent pixel sets comprise white, red, green and blue colors.

The pixel arrangements of the display panel 600 comprise: in the scan line direction, the sub-pixels in two adjacent pixel sets 620 have different colors, and have positive and negative polarities arranged alternately; and in the data line direction, the adjacent sub-pixels 631 in the two adjacent pixel sets 630 have the same color and reverse polarities.

Figure 11:
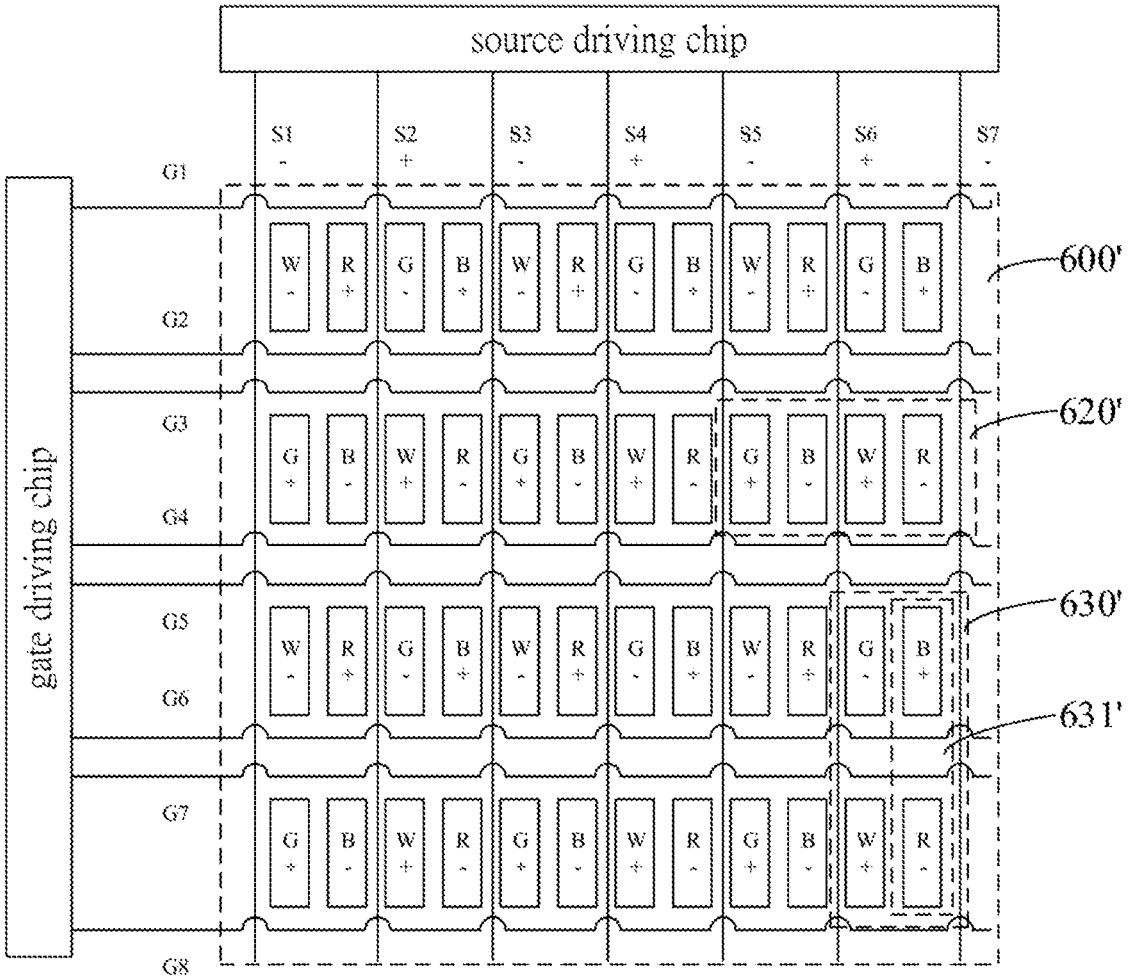
FIG. 11 is a schematic view showing a display panel structure of another embodiment.

In one of the embodiments, as shown in FIG. 11, the pixel arrangements of the display panel 600' comprise: in the scan line direction, the sub-pixels in two adjacent pixel sets 620' have different colors, and have positive and negative polarities arranged alternately; and in the data line direction, the adjacent sub-pixels 631' in the two adjacent pixel sets 630' have different colors and reverse polarities; wherein the white sub-pixel (W) neighbors on the green sub-pixel (G), and the red sub-pixel (R) neighbors on the blue sub-pixel (B).

In the display panel 600, the arranged orders of the colors of the sub-pixels in the odd-numbered columns and the even-numbered columns are the same. That is, the sub-pixels on the same row of sub-pixels have the same color. If the sub-pixels of the odd-numbered columns or the even-numbered columns in the display panel 600 are integrally shifted by the distance of two sub-pixels (i.e., one pixel set 610), then the arrangement of the display panel 600' can be obtained.

In the pixel driving circuit, the driving method and the display device, in which the technology of the HSD pixel layout design is utilized, only two data lines are provided for each pixel unit, the number of the source ICs used can be decreased, and the cost can be saved. The frame displaying quality is enhanced since the pixel polarity arrangement of the dot inversion is adopted. More importantly, since the technology of the HSD pixel layout design and the pixel polarity arrangement of the dot inversion are utilized, no polarity switching of the source voltage signal in one frame is needed, so that the power consumption of the overall display device and the temperature of the source IC are decreased, and the reliability quality is enhanced.

The technical characteristics of the above-mentioned embodiments may be combined arbitrarily. In order to make the description concise, all possible combinations of the technical characteristics of the above-mentioned embodiments are not fully described. However, as long as no contradiction is present in the combinations of these technical characteristics, the combinations should be deemed as falling within the scope of this disclosure.

Although this disclosure has been described with reference to specific embodiments, this description is not meant to be construed in a limiting sense. Various modifications and improvements of the disclosed embodiments will be apparent to persons skilled in the art and deemed as falling within the scope of the claims. It is, therefore, contemplated that the appended claims will cover all modifications that fall within the true scope of the invention.

What is claimed is:

1. A pixel driving circuit, comprising:

a pixel array comprising a plurality of pixel units, wherein each of the pixel units has four sub-pixels with different colors, and all of the sub-pixels are arranged in a dot inversion arrangement, and positive and negative polarities of the sub-pixels are alternately disposed; and data lines and scan lines orthogonally disposed to define the pixel array, wherein two of the scan lines are provided for each of columns of the pixel units, and two of the data lines are provided for each of rows of the pixel units;

wherein each of the data lines is connected to closest two of the sub-pixels having a same polarity when passing through one of the columns of the pixel units, all the sub-pixels connected to the same data line in a row direction have the same polarity, and the sub-pixels connected to the adjacent data lines have reverse polarities;

wherein the columns of the pixel units are divided into odd-numbered columns of pixel units and even-numbered columns of pixel units, and the four sub-pixels in the odd-numbered columns of pixel units and the four sub-pixels in the even-numbered columns of pixel units have the same arrangement order being a first order, in which a first sub-pixel, a second sub-pixel, a third sub-pixel and a fourth sub-pixel of the four sub-pixels are arranged in order, wherein the four sub-pixels in the odd-numbered columns of pixel units are arranged in a first order, and the four sub-pixels in the even-numbered columns of pixel units are arranged in a second order, in which a third sub-pixel, a fourth sub-pixel, a first sub-pixel and a second sub-pixel of the four sub-pixels are arranged in order.

2. The pixel driving circuit according to claim 1, wherein:

the four sub-pixels in the odd-numbered columns of pixel units are arranged in a second order, in which a third sub-pixel, a fourth sub-pixel, a first sub-pixel and a second sub-pixel of the four sub-pixels are arranged in order, and the four sub-pixels in the even-numbered columns of pixel units are arranged in a first order.

3. The pixel driving circuit according to claim 1, wherein:

in each of the rows of the pixel units, the two data lines are a first data line and a second data line arranged in order;

the first data line is disposed adjacent to the first sub-pixel in the four sub-pixels arranged in the first order; and the second data line is disposed between the second sub-pixel and the third sub-pixel in the four sub-pixels arranged in the first order.

4. The pixel driving circuit according to claim 3, wherein the four sub-pixels in the odd-numbered columns of the pixel units and the four sub-pixels in even-numbered columns of the pixel units have the same arrangement order being the first order, and the data lines and the sub-pixels are connected as follows:

in the odd-numbered columns, the first data line is connected to the third sub-pixel in the adjacent row of the pixel units and the first sub-pixel in the current row of the pixel units, and the second data line is connected to the second sub-pixel in the current row of the pixel units and the fourth sub-pixel in the current row of the pixel units; and in the even-numbered columns, the first data line is connected to the fourth sub-pixel in the adjacent row of the pixel units and the second sub-pixel in the current row of the pixel units, and the second data line is connected to the first sub-pixel in the current row of the pixel units and the third sub-pixel in the current row of the pixel units.

5. The pixel driving circuit according to claim 3, wherein the four sub-pixels in the odd-numbered columns of the pixel units and the four sub-pixels in even-numbered columns of the pixel units have the same arrangement order being the first order, and the data lines and the sub-pixels are connected as follows:

in the odd-numbered columns, the first data line is connected to the fourth sub-pixel in the adjacent row of the pixel units and the second sub-pixel in the current row of the pixel units, and the second data line is connected to the first sub-pixel in the current row of the pixel units and the third sub-pixel in the current row of the pixel units; and in the even-numbered columns, the first data line is connected to the third sub-pixel in the adjacent row of the pixel units and the first sub-pixel in the current row of the pixel units; and the second data line is connected to the second sub-pixel in the current row of the pixel units and the fourth sub-pixel in the current row of the pixel units.

6. The pixel driving circuit according to claim 3, wherein the four sub-pixels in the odd-numbered columns of pixel units are arranged in the first order, the four sub-pixels in the even-numbered columns of pixel units are arranged in the second order, and the data lines and the sub-pixels are connected as follows:

in the odd-numbered columns, the first data line is connected to the third sub-pixel in the adjacent row of the pixel units and the first sub-pixel in the current row of the pixel units, and the second data line is connected to the second sub-pixel in the current row of the pixel units and the fourth sub-pixel in the current row of the pixel units; and in the even-numbered columns, the first data line is connected to the second sub-pixel in the adjacent row of the pixel units and the fourth sub-pixel in the current row of the pixel units; and the second data line is connected to the third sub-pixel in the current row of the pixel units and the first sub-pixel in the current row of the pixel units.

7. The pixel driving circuit according to claim 3, wherein the four sub-pixels in the odd-numbered columns of pixel units are arranged in the first order, the four sub-pixels in the even-numbered columns of pixel units are arranged in the second order, and the data lines and the sub-pixels are connected as follows:

in the odd-numbered columns, the first data line is connected to the fourth sub-pixel in the adjacent row of the pixel units and the second sub-pixel in the current row of the pixel units, and the second data line is connected to the first sub-pixel in the current row of the pixel units and the third sub-pixel in the current row of the pixel units; and in the even-numbered columns, the first data line is connected to the first sub-pixel in the adjacent row of the pixel units and the third sub-pixel in the current row of the pixel units, and the second data line is connected to the fourth sub-pixel in the current row of the pixel units and the second sub-pixel in the current row of the pixel units.

8. The pixel driving circuit according to claim 3, wherein the four sub-pixels in the odd-numbered columns of pixel units are arranged in the second order, the four sub-pixels in the even-numbered columns of pixel units are arranged in the first order, and the data lines and the sub-pixels are connected as follows:

in the odd-numbered columns, the first data line is connected to the first sub-pixel in the adjacent row of the pixel units and the third sub-pixel in the current row of the pixel units, and the second data line is connected to the fourth sub-pixel in the current row of the pixel units and the second sub-pixel in the current row of the pixel units; and in the even-numbered columns, the first data line is connected to the fourth sub-pixel in the adjacent row of the pixel units and the second sub-pixel in the current row of the pixel units, and the second data line is connected to the first sub-pixel in the current row of the pixel units and the third sub-pixel in the current row of the pixel units.

9. The pixel driving circuit according to claim 3, wherein the four sub-pixels in the odd-numbered columns of pixel units are arranged in the second order, the four sub-pixels in the even-numbered columns of pixel units are arranged in the first order, and the data lines and the sub-pixels are connected as follows:

in the odd-numbered columns, the first data line is connected to the second sub-pixel in the adjacent row of the pixel units and the fourth sub-pixel in the current row of the pixel units, and the second data line is connected to the third sub-pixel in the current row of the pixel units and the first sub-pixel in the current row of the pixel units; and in the even-numbered columns, the first data line is connected to the third sub-pixel in the adjacent row of the pixel units and the first sub-pixel in the current row of the pixel units, and the second data line is connected to the second sub-pixel in the current row of the pixel units and the fourth sub-pixel in the current row of the pixel units.

* * * * *